US008302816B2

(12) United States Patent
Sim

(10) Patent No.: US 8,302,816 B2
(45) Date of Patent: Nov. 6, 2012

(54) SPRAY BOTTLE WITH REFILL CARTRIDGE

(76) Inventor: Jae K. Sim, Rancho Cucamonga, CA (US)

( * ) Notice: Subject to any disclaimer, the term of this patent is extended or adjusted under 35 U.S.C. 154(b) by 488 days.

(21) Appl. No.: 12/560,968

(22) Filed: Sep. 16, 2009

(65) Prior Publication Data

US 2010/0089947 A1 Apr. 15, 2010

Related U.S. Application Data

(63) Continuation-in-part of application No. 12/270,735, filed on Nov. 13, 2008.

(60) Provisional application No. 61/105,734, filed on Oct. 15, 2008.

(51) Int. Cl.
*B67D 5/06* (2006.01)

(52) U.S. Cl. ..... 222/129; 222/383.1; 222/325

(58) Field of Classification Search ..... 222/464.1, 222/383.1, 382, 325, 129, 481.5, 136; 206/219; 215/386

See application file for complete search history.

(56) References Cited

U.S. PATENT DOCUMENTS

| | | | | |
|---|---|---|---|---|
| 2,642,065 | A | 4/1951 | Negri | |
| 3,024,947 | A | 3/1962 | Jeynes, Jr. et al. | |
| 3,080,094 | A | 3/1963 | Modderno | |
| 3,134,505 | A | 5/1964 | Modderno | |
| 3,156,369 | A * | 11/1964 | Bowes et al. | 206/222 |
| 3,172,568 | A | 3/1965 | Modderno | |
| 3,221,946 | A | 12/1965 | Riley | |
| 3,240,391 | A | 3/1966 | Garton | |
| 3,240,403 | A | 3/1966 | Modderno | |
| 3,255,924 | A | 6/1966 | Modderno | |
| 3,255,926 | A | 6/1966 | Modderno | |
| 3,314,563 | A | 4/1967 | Mounier | |
| 3,318,484 | A | 5/1967 | Modderno | |
| 3,355,238 | A * | 11/1967 | Schwartzman | 401/41 |
| 3,458,076 | A | 7/1969 | Babcock | |
| 3,548,562 | A | 12/1970 | Schwattzman | |
| 3,613,955 | A | 10/1971 | Wethrell, Jr. | |
| 3,648,899 | A | 3/1972 | Lukesch et al. | |
| 3,655,096 | A | 4/1972 | Easter | |
| 3,891,125 | A | 6/1975 | Morane et al. | |
| 4,221,291 | A | 9/1980 | Hunt | |
| 4,355,739 | A * | 10/1982 | Vierkotter | 222/134 |
| 4,613,061 | A | 9/1986 | Meuresch et al. | |

(Continued)

FOREIGN PATENT DOCUMENTS

| | | |
|---|---|---|
| DE | 8101400 | 5/1981 |

(Continued)

*Primary Examiner* — Kevin P Shaver
*Assistant Examiner* — Donnell Long
(74) *Attorney, Agent, or Firm* — Stetina Brunda Garred & Brucker

(57) ABSTRACT

A refill cartridge disposable within a spray bottle during usage thereof. The refill cartridge includes a cartridge body defining a cartridge reservoir. The cartridge body includes first and second openings, the second opening being defined by a projection of the cartridge body. A cap is connected to the cartridge body to substantially cover the first opening. The cap includes a cap base having a primary opening. A cap boss is connected to and extends from the cap base and defines a passage concentrically aligned with the primary opening. The refill cartridge additionally includes a plug having a plug body including a plug neck and a flared portion. The plug is engageable with the cap and the cartridge body and is moveable relative to the cap and cartridge body between a sealing position and a dispensing position.

17 Claims, 5 Drawing Sheets

U.S. PATENT DOCUMENTS

| | | | | |
|---|---|---|---|---|
| 4,705,191 | A | 11/1987 | Itzel et al. | |
| 4,757,916 | A | 7/1988 | Goncalves | |
| 4,821,923 | A * | 4/1989 | Skorka | 222/80 |
| 4,950,237 | A | 8/1990 | Henault et al. | |
| 5,246,142 | A | 9/1993 | Di Palma et al. | |
| 5,273,189 | A | 12/1993 | Jouillat et al. | |
| 5,348,060 | A | 9/1994 | Futagawa et al. | |
| 5,421,483 | A | 6/1995 | Parise | |
| 5,875,888 | A | 3/1999 | Albisetti | |
| 5,927,549 | A | 7/1999 | Wood | |
| 5,944,223 | A | 8/1999 | Klima et al. | |
| 5,957,335 | A | 9/1999 | Otto | |
| 5,992,693 | A | 11/1999 | Albisetti | |
| 6,041,969 | A | 3/2000 | Parise | |
| 6,053,371 | A | 4/2000 | Durliat et al. | |
| 6,152,326 | A | 11/2000 | Klima, Jr. et al. | |
| 6,155,459 | A | 12/2000 | Bunschoten | |
| 6,182,865 | B1 | 2/2001 | Bunschoten et al. | |
| 6,290,100 | B1 | 9/2001 | Yacko | |
| 6,360,918 | B1 | 3/2002 | Butler | |
| 6,568,562 | B1 * | 5/2003 | Klima et al. | 222/82 |
| 6,997,351 | B2 * | 2/2006 | Cho | 222/82 |
| 7,066,354 | B2 | 6/2006 | Stank | |
| 7,331,486 | B2 | 2/2008 | Mon | |
| 2007/0228074 | A1 * | 10/2007 | Mueller et al. | 222/129 |
| 2009/0139882 | A1 | 6/2009 | DeJong | |

FOREIGN PATENT DOCUMENTS

| | | |
|---|---|---|
| DE | 3535986 | 4/1987 |
| EP | 101594 | 2/1984 |
| EP | 173547 | 3/1986 |
| EP | 333541 | 9/1989 |
| EP | 341115 | 11/1989 |
| FR | 2239390 | 2/1975 |
| GB | 2220930 | 1/1990 |
| IT | 1188018 | 12/1987 |

* cited by examiner

SPRAY BOTTLE WITH REFILL CARTRIDGE

CROSS-REFERENCE TO RELATED APPLICATIONS

The present application is a continuation-in-part of U.S. application Ser. No. 12/270,735 entitled SPRAY BOTTLE WITH REFILL CARTRIDGE filed Nov. 13, 2008, and claiming the benefit of U.S. Provisional Application No. 61/105,734 filed on Oct. 15, 2008 and entitled SPRAY BOTTLE WITH REFILL CARTRIDGE, the disclosures of Ser. Nos. 12/270,735 and 61/105,734 being incorporated herein by reference.

STATEMENT RE: FEDERALLY SPONSORED RESEARCH/DEVELOPMENT (Not Applicable)

BACKGROUND OF THE INVENTION

1. Field of the Invention

The present invention relates generally to a refill cartridge for a spray bottle, and more particularly to an easy to use refill cartridge configured to be disposed within the spray bottle during usage thereof.

2. Description of the Related Art

It is well known in the art to employ the use of a spray bottle to dispense a fluid. For instance, cleaners, cosmetics, and other fluids are commonly sold in spray bottles to facilitate dispensing by a user. After repeated use of the spray bottle, the amount of liquid in the bottle decreases to the point where the spray bottle is effectively empty.

Once the spray bottle is empty, many users are inclined to throw the empty spray bottle away and purchase a new spray bottle, despite the fact that the empty spray bottle is still capable of dispensing fluid. Given that a typical spray bottle is generally designed to hold a small amount of fluid (i.e., one quart), a user may quickly consume all of the fluid contained within the spray bottle. As such, a large number of spray bottles may be used over a short period of time.

Many spray bottles are formed out of a environmentally harmful materials, such as plastics. Therefore, large consumption of such spray bottles may have detrimental effects on the environment.

As an alternative to buying a new spray bottle upon emptying a previous spray bottle, a user can often times purchase a refill which usually contains a smaller amount of the fluid in a higher concentration. The fluid in the refill can be poured into the spray bottle and mixed with water or other diluting fluids to fill the spray bottle. Purchasing a refill tends to be more environmentally friendly, as the refill container is typically smaller than the original spray bottle container. Furthermore, the refill tends to be less expensive than purchasing a new spray bottle.

Although purchasing a refill offers certain advantages, many consumers are more likely to purchase a brand new spray bottle rather than purchase a refill. In this manner, many consumers have a habit of throwing away a spray bottle when it is empty rather than storing an empty spray bottle until they can buy a refill. Once the consumer throws the empty spray bottle away, there are precluded from purchasing a refill. Furthermore, when refills are sold on a shelf next to a full spray bottle, consumers may be inclined to purchase the new spray bottle rather than the refill.

As is apparent from the foregoing, there exists a need in the art for a new spray bottle refill, and a method of distributing the refill with the spray bottle. The present invention addresses this particular need, as will be discussed in more detail below.

BRIEF SUMMARY OF THE INVENTION

According to an aspect of the present invention there is provided a refill cartridge which may be disposed within a spray bottle during usage of the spray bottle. The refill cartridge includes a cartridge body defining a cartridge reservoir. The cartridge body includes a first opening and a second opening which is defined by a projection of the cartridge body. The refill cartridge further includes a cap connected to the cartridge body to substantially cover the first opening. The cap includes a cap base having a primary opening. A cap boss is connected to and extends from the cap base. The cap boss defines a passage concentrically aligned with the primary opening. The refill cartridge additionally includes a plug having a plug body including a plug neck and a flared portion, with the plug neck defining a distal end. The plug is engageable with the cap and the cartridge body and is moveable relative to the cap and cartridge body between a sealing position and a dispensing position. In the sealing position, the plug neck is advanced through the cap boss, with the distal end of the plug protruding through the primary opening beyond the cap base. Additionally, the flared portion of the plug is frictionally engaged with the projection of the cartridge body to form a fluid tight seal therebetween. In the dispensing position, the flared portion is moved from fluid tight engagement with the projection of the cartridge body.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION OF THE INVENTION

Figure 1:
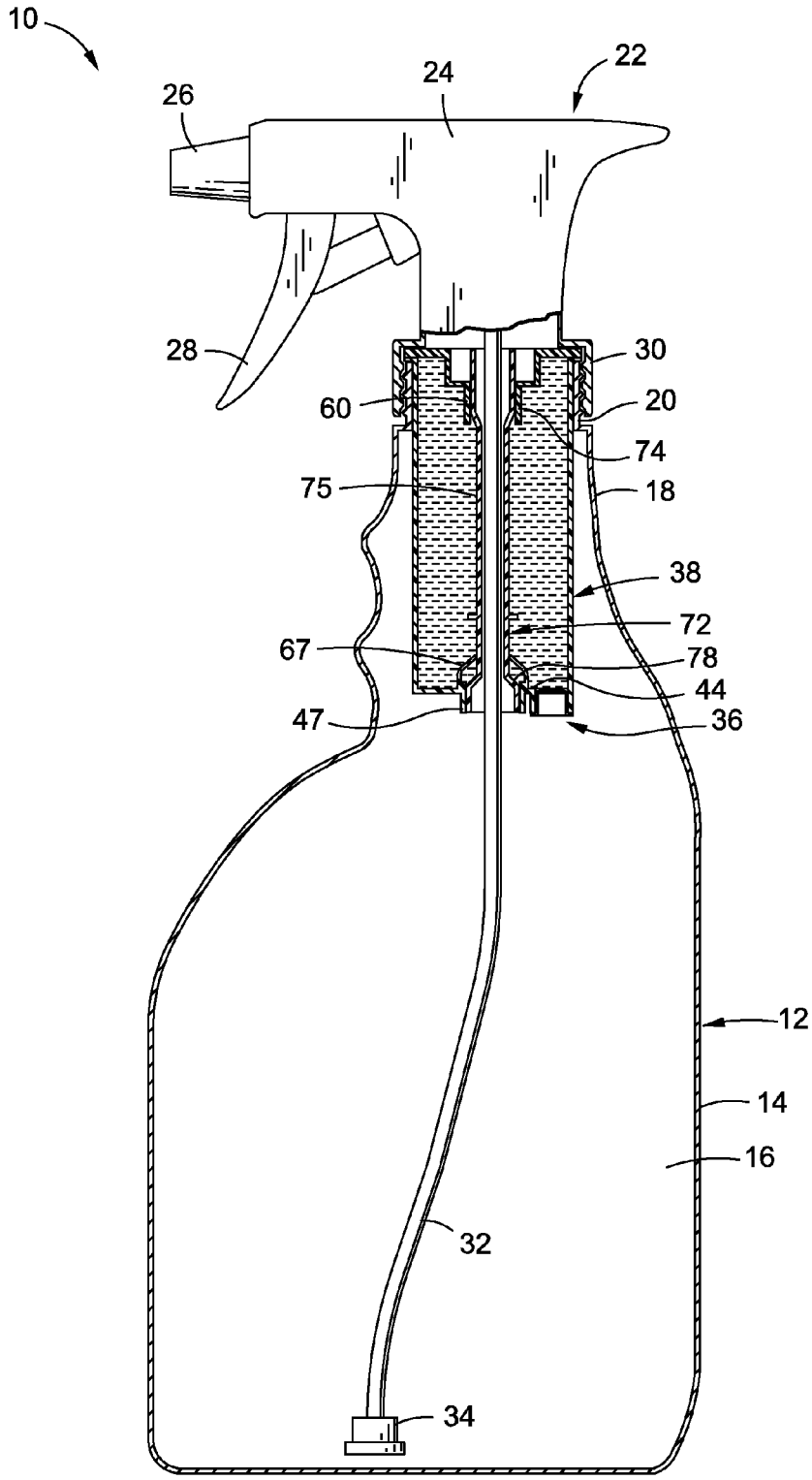
FIG. 1 is a side sectional view of a spray bottle assembly constructed in accordance with an embodiment of the present invention, the spray bottle assembly including a bottle, a pumping mechanism, and a refill cartridge having a cartridge body, a cap, and a plug.
Figure 2:
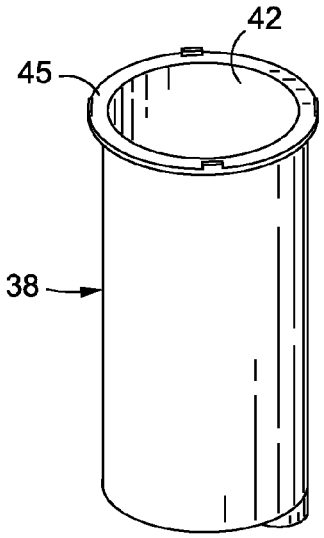
FIG. 2 is a top perspective view of the cartridge body of the refill cartridge.

Referring now to the drawings wherein the showings are for purposes of illustrating a preferred embodiment of the present invention only, and not for purposes of limiting the same, FIGS. 1-13 illustrate a spray bottle assembly 10 constructed in accordance with a first embodiment of the present invention. The spray bottle assembly 10 may be used to easily dispense fluids, such as cleaning fluids, detergents, cosmetic fluids, perfumes, or other fluids known in the art. As described in more detail below, the spray bottle assembly 10 includes a pumping mechanism 22, a bottle 12 and a refill cartridge 36 that is disposable within the bottle 12. It is contemplated that the refill cartridge 36 may be packaged within the bottle 12 for sale. If provided with the bottle 12, the refill cartridge 36 gives consumers a "two for one" purchase, since the refill cartridge 36 may be used to facilitate the refill of the bottle 12 in a manner which will be described in more detail below. The easy-to-use configuration of the refill cartridge 36 allows for simple refilling of the bottle 12, thereby extending the usage of the bottle 12, which provides environmental and economic advantages.

Referring specifically to FIG. 1, the spray bottle assembly 10 includes the pumping mechanism 22 that is engageable with the bottle 12. The pumping mechanism 22 includes a body 24 having a nozzle 26, a trigger 28, and a tube 32 connected thereto. The tube 32 defines a tube end 34 that is disposable within a fluid for purposes of dispensing the fluid through the nozzle 26. In this manner, the nozzle 26 is in fluid communication with the tube 32.

The trigger 28 is moveable relative to the body 24 to dispense fluid from the nozzle 26. More specifically, the trigger 28 is moveable between an extended position and a retracted position relative to the body 24. As the trigger 28 moves from the extended position toward the retracted position, fluid is communicated from the tube 32 to the nozzle 26. In one embodiment, the trigger 28 is biased towards the extended position. The biasing force may be provided by a spring or other biasing elements.

The nozzle 26 may be moveable relative to the body 24 to control the output of fluid therethrough. In particular, the nozzle 26 may be configured to dispense a fluid in a stream-like manner, or in a mist. In this regard, the nozzle 26 may rotate relative to the body 24 to modify the fluid output from a stream to a mist. The nozzle 26 may also be closed to restrict the passage of fluid therethrough.

According to one embodiment, the pumping mechanism 22 is attachable to the bottle 12 via a pump attachment element 30 that is sized and configured to engage with an engagement region 20 formed on the bottle 12 and defining a rim thereof. The engagement region 20 preferably comprises threads formed on the exterior of the neck portion 18 of the bottle 12. The tube 32 may extend into the interior of the bottle 12 (which is typically fluid-filled) when the pumping mechanism 22 is connected to the bottle 12. In the embodiment illustrated in FIG. 1, the attachment element 30 includes internal threads that engage with external threads of the engagement region 20 disposed on the neck portion 18 of the bottle 12. The internal threads engage with the external threads as the attachment element 30 is rotated or screwed onto the bottle 12. Although the embodiment illustrated in the drawings shows an attachment element 30 having internal threads, it is understood that other embodiments may include external threads that engage with internal threads formed in the bottle 12. Furthermore, it is contemplated that other embodiments of the attachment element 30 will not threadably engage with the bottle 12. For instance, various mechanical fasteners known in the art may be used to engage the pumping mechanism 22 to the bottle 12.

The bottle 12 includes a bottle wall 14 that is preferably formed out of a substantially fluid impermeable material, such as plastic, rubber, or other materials known in the art. The size and shape of the bottle 12 may vary. The bottle 12 depicted in FIG. 1 includes an ergonomic gripping portion configured to assist a user in grasping the bottle 12. The bottle wall 14 defines a reservoir 16 configured to receive a fluid, such as a cleaning fluid, or other fluids.

In operation, the pumping mechanism 22 is connected to a fluid filled bottle 12, with the tube 32 extending into the interior of the bottle 12. As a user repeatedly moves the trigger 28 from the extended position to the retracted position, the fluid contained within the bottle 12 is drawn in to the tube 32 via the tube end 34 and travels through the tube 32 and is dispensed out of the nozzle 26. The fluid level within the bottle 12 lowers as the fluid is dispensed through the nozzle 26. The bottle 12 may additionally include a secondary reservoir to facilitate dispensing of the fluid when the bottle 12 is tilted relative to a horizontal plane, as described in U.S. Provisional Application No. 61/097,827 entitled Spray Bottle with Primary and Secondary Internal Reservoirs, the entire contents of which are expressly incorporated herein by reference.

Referring now specifically to FIGS. 2-5, the refill cartridge 36 includes a cartridge body 38 defining a reservoir 40 configured to store fluid. In this manner, the cartridge body 38 is preferably formed of a fluid impermeable material, such as plastic or rubber. As depicted, the cartridge body 38 is substantially cylindrical in shape and extends along a longitudinal cartridge axis 48. In this manner, the cartridge body 38 is sized and configured to be disposed within the upper neck portion 18 of the bottle 12, as described in more detail below. Those skilled in the art will appreciate that the cartridge body 38 may define other non-cylindrical shapes and configurations.

The cartridge body 38 defines a first opening 42 and a second opening 46 at respective opposing ends of the cartridge body 38. The cartridge body 38 includes a flange 45 extending about and protruding radially relative to the first opening 42. The flange 45 has an outer diameter that is greater than the diameter of the rim of the bottle 12 which defines a bottle opening thereof, as best shown in FIG. 1. In this manner, the refill cartridge 36 may be inserted within the bottle reservoir 16 with the flange 45 resting on the rim of the bottle 12 defined at the bottle opening thereof.

Figure 3:
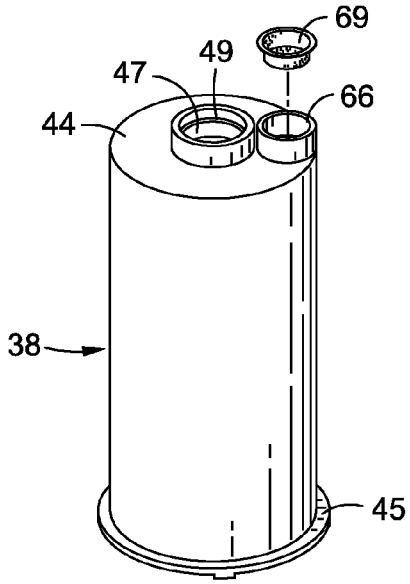
FIG. 3 is a top perspective view of the cartridge body illustrated in FIG. 2, the cartridge body being rotated 180 degrees.
Figure 5:
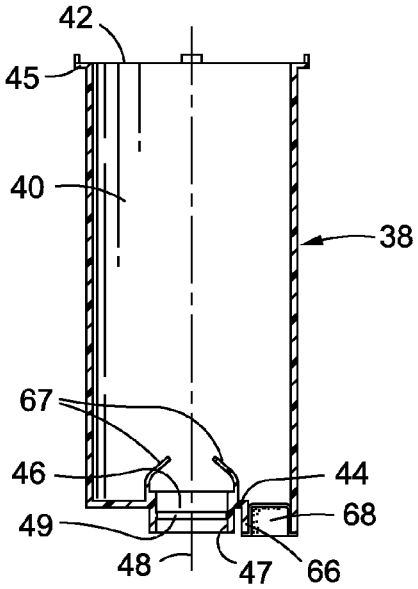
FIG. 5 is a side sectional view of the cartridge body depicted in FIG. 4.
Figure 6:
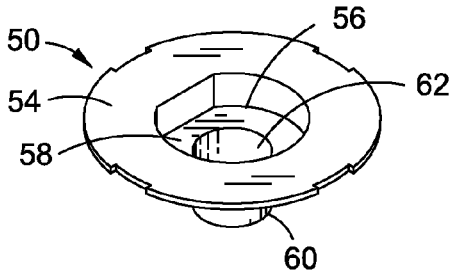
FIG. 6 is a top perspective view of the cap of the refill cartridge.
Figure 7:
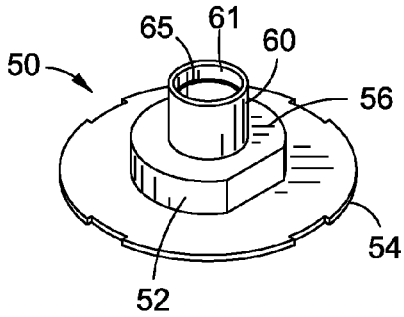
FIG. 7 is a top perspective view of the cap illustrated in FIG. 6, the cap being rotated 180 degrees.
Figure 8:
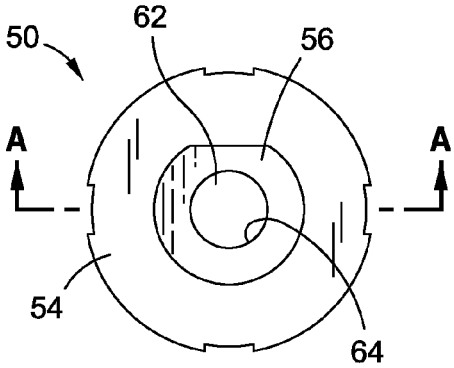
FIG. 8 is a top plan view of the cap.
Figure 9:
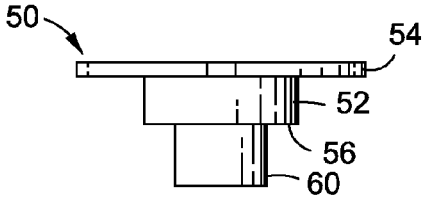
FIG. 9 is a side elevational view of the cap illustrated in FIG. 8.
Figure 10:
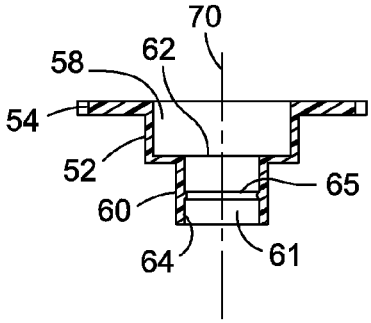
FIG. 10 is a cross-sectional view of the cap illustrated in FIG. 8.

As best shown in FIG. 5, the cartridge body 38 of the refill cartridge 36 also includes a bottom wall 44 having a ring-like projection 47 which protrudes from the approximate center thereof and defines the second opening 46. The projection 47 has an outer diameter that is smaller than the maximum outer diameter of the cartridge body 38. The first and second openings 42, 46 are coaxially aligned with each other along the cartridge axis 48. Formed on the inner surface of the projection 47 is a continuous sealing ring 49, the use of which will be described in more detail below. As will also be described in more detail below, a plug 72 may be inserted into the ring opening 47 (as shown in FIG. 1) to selectively mitigate fluid flow through the ring opening 47. In addition to the projection 47, also formed on the bottom wall 44 is a second ring-like projection 66. As shown in FIGS. 3 and 5, the projection 66 is offset from the center of the axis 48. The projection 66 defines an opening 68 that extends through the bottom wall 44 and fluidly communicates with the reservoir 40 of the cartridge body 38.

Figure 4:
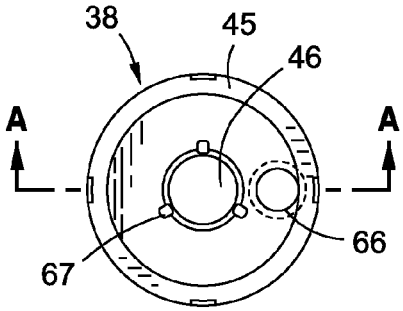
FIG. 4 is a top plan view of the cartridge body.

As best seen in FIGS. 4 and 5, the cartridge body 38 further includes a plurality (e.g., three) support arms 67 which are formed on the interior surface of the bottom wall 44 and project or protrude into the interior of the reservoir 40. More particularly, the support arms 67 are preferably arranged about the axis 48 in equidistantly spaces intervals of approximately 120°. As best seen in FIG. 5, each of the support arms 67 is formed such that the end portion thereof disposed furthest from the bottom wall 44 is angled toward the axis 48. Further, each of the support arms 67, in addition to being integrally connected to the bottom wall 44, preferably has a relatively thin profile. The use of the support arm 67 will also be described in more detail below. Those of ordinary skill in the art will recognize that the inclusion of three support arms 67 with the cartridge body 38 in equidistantly spaced intervals of approximately 120° is exemplary only, and that greater or fewer support arms 67 provided in a different spacing may be included with the cartridge body 38 without departing from the spirit and scope of the present invention.

Referring now to FIGS. 6-10, the refill cartridge 36 also includes a cap 50 that is engageable with the cartridge body 38 at the first opening 42 to substantially cover the first opening 42. The cap 50 includes a circular cap base 56 and an annular cap wall 52 extending upwardly from the cap base 56. An annular cap flange 54 may circumscribe and protrude radially from the upper end of the cap wall 52 (opposite the cap base 56). The cap base 56 includes an opening 62 formed therein. The cap wall 52 and the cap base 56 collectively define a cavity 58. As shown, the shape of the cap wall 52 is complimentary to the cylindrical shape of the cartridge body 38. In this manner, the outer diameter of the cap wall 52 is slightly smaller than the inner diameter of the cartridge body 38 at the first opening 42 to allow the cap 50 to be partially advanced into the cartridge body 38 when engaged thereto.

The cap 50 also includes a tubular cap boss 60 extending axially downwardly from the cap base 56 along an axis 70. The cap boss 60 includes an inner wall 64 defining a passage 61 that is coaxially aligned with the primary opening 62. Formed on the inner wall 64 of the cap boss 60 is a sealing ring 65, the use of which will also be described in more detail below.

The cap 50 may be placed within the first opening 42 of the cartridge body 38 of the refill cartridge 36 to cover and enclose the first opening 42. In this manner, the cap flange 54 preferably abuts the flange 45. When the cap 50 is connected to the cartridge body 38, the cap axis 70 is preferably aligned with the cartridge axis 48. As a result, the cap axis 70 is coaxially aligned with the cartridge axis 48. Once the cap 50 is engaged with the cartridge body 38, the cap 50 may be sealed to the cartridge body 38. In this regard, the interface between the cap 50 and the cartridge body 38 may be a substantially fluid tight seal. When the cap 50 is connected to the cartridge body 38, the refill cartridge 36 may be filled with a fluid via the opening 68. Once the reservoir 40 is filled, it is contemplated that the opening 68 will be sealed with a suitable plug 69.

Figure 12:
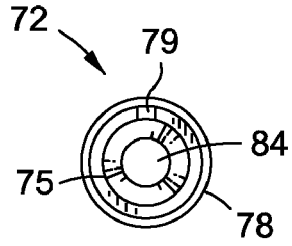
FIG. 12 is a top plan view of the plug.
Figure 11:
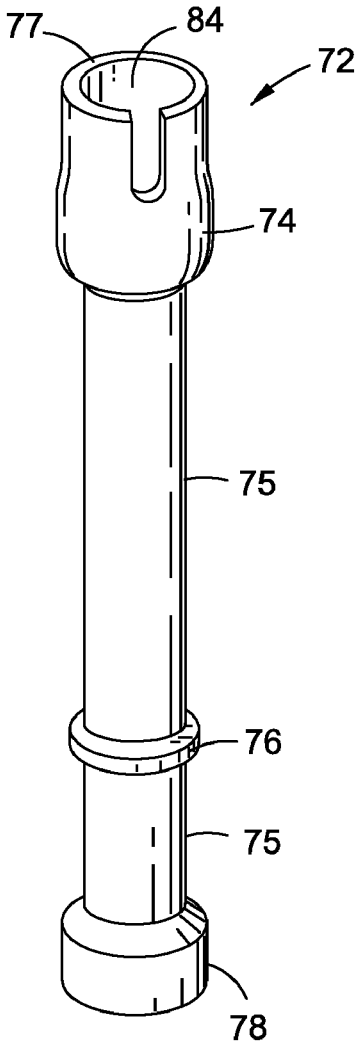
FIG. 11 is a top perspective view of the plug of the refill cartridge.
Figure 13:
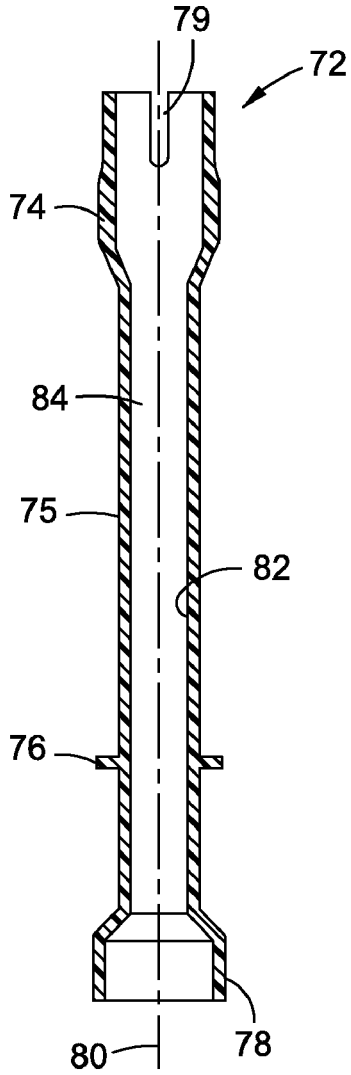
FIG. 13 is a cross-sectional view of the plug illustrated in FIG. 12.

Referring now to FIGS. 11-13, there is shown a plug 72 that is cooperatively engaged to the cartridge body 38 and the cap 50. The plug 72 includes an elongate, tubular plug body 75. Formed on one end of the plug body 75 is an enlarged plug neck 74 of the plug 72. The plug neck 74 includes a distal end 77 which defines one of the opposed ends of the plug 72. Both the plug body 75 and the plug neck 74 have substantially circular cross-sectional configurations. As seen in FIGS. 11 and 13, the plug neck 74 includes an elongate slot 79 formed therein, the slot 79 extending from the distal end 77 to a point approximately halfway along the length of the plug neck 74. As is apparent from FIGS. 11 and 13, the plug neck 74 is not of uniform outer diameter along the length thereof. Rather, that portion of the plug neck 74 extending from the distal end 77 to approximately the point of termination of the slot 79 is of a first outer diameter, with the remainder of the plug neck 74 being of a second outer diameter which slightly exceeds the first outer diameter. However, the inner diameters of these two portions of the plug neck are preferably substantially equal. The functionality of these differing diameter portions of the plug neck 74 and the slot 79 disposed therein will be described in more detail below.

In addition to the plug neck 74 and plug body 75, the plug 72 includes a flared portion 78 which is formed on that end of the plug body 75 opposite that having the plug neck 74 formed thereon. The flared portion 78 also has a generally circular cross-sectional configuration, and an outer diameter which exceeds that of the plug body 75. As best seen in FIG. 13, the plug neck 74, plug body 75, and flared portion 78 collectively define a flow passage 84 which extends along a plug axis 80. The slot 79 described above extends along an axis which is spaced from and generally parallel to the plug axis 80. Also, the majority of the length of the flow passage 84 is defined by the inner wall 82 of the plug body 75 of the plug 72. It is contemplated that the diameter of the inner wall 82 will exceed the outer diameter of the above-described tube 32, thus allowing for the slidable advancement of the tube 32 through the plug 72, and hence the refill cartridge 36, in the manner shown in FIG. 1 and as will be described in more detail below. The plug 72 also includes a plug flange 76 which circumscribes the plug body 75 and protrudes radially outward therefrom. As seen in FIGS. 11 and 13, the plug flange 76 is disposed in closer proximity to the flared portion 78 than to the plug neck 74. The use of the plug flange 76 will also be described in more detail below.

In the cartridge 36, the plug 72 is cooperatively engageable to both the cartridge body 38 and the cap 50, and is selectively moveable between a sealing position (shown in FIG. 1) and a dispensing position relative thereto. In this regard, when the plug 72 is in the sealing position relative to the remainder of the cartridge 36, the flared portion 78 of the plug 72 is operatively seated within and placed in sealed engagement to the projection 47 of the cartridge body 38. More particularly, when the plug 72 is in its sealing position, that end of the plug 72 defined by the flared portion 78 is substantially flush or continuous with the distal rim defined by the projection 47. When the flared portion 78 is in this particular position relative to the cartridge body 38, the sealing ring 49 formed on the inner surface of the projection 47 is frictionally engaged to the outer surface of the flared portion 78 in a manner facilitating the creation of a fluid tight-seal therebetween.

In addition to the foregoing, when the plug 72 is in its sealing position, the plug neck 74 of the plug 72 is advanced through the cap boss 60 of the cap 50, with a portion of the plug neck 74 (including the reduced diameter portion defining the distal end 77) protruding from the primary opening 62 into the cavity 58. More particularly, as best seen in FIG. 1, when the plug 72 is in its sealing position, the distal end 77 extends in generally co-planar relation to the cap flange 54 of the cap 50. At the same time, the end of the plug neck 74 opposite that defined by the distal end 77 is substantially aligned with the distal rim defined by the cap boss 60 of the cap 50. Importantly, when the plug 72 is in its sealing position and the plug neck 74 oriented relative to the cap 50 in the manner described above, the sealing ring 65 formed on the inner wall 64 of the cap boss 60 frictionally engages that portion of the outer surface of the plug neck 74 of increased diameter in a manner creating a fluid-tight seal therebetween. Due to the fluid-tight seal created between the sealing ring 65 and the plug neck 74, and between the sealing ring 49 and the flared portion 78, any fluid filled into the reservoir 40 of the cartridge 36 is effectively maintained therein when the plug 72 is in its sealing position. Further, when the plug 72 is in its sealing position, the slot 79 formed in the plug neck 74 does not communicate with any portion of the reservoir 40. Rather, that end of the slot 79 disposed closest to the plug body 75 resides within the interior of the cap boss 60 of the cap 50. Also, the plug flange 76 is spaced from the distal ends of the support arms 67 by a distance which is substantially equal to, but slightly less than the distance by which the plug neck 74 protrudes from the cap flange 54 when the plug 72 is in its sealing position.

As indicated above, the plug 72 is moveable relative to the cap 50 and the cartridge body 38 from its sealing position shown in FIG. 1, to a dispensing position. The movement of the plug 72 from its sealing position to its dispensing position is facilitated by the application of downward pressure by an external object (such as one finger of a consumer) to the exposed distal end 77 defined by the plug neck 74 of the plug 72. As the plug 72 is moved from the sealing position toward the dispensing position, the flared portion 78 is moved downwardly along the axis 48 (when viewed from the perspective shown in FIG. 1) from within and thus out of fluid-tight engagement with the projection 47. Such downward movement of the plug 72 is terminated or limited by the abutment of the plug flange 76 against the distal ends of the support arms 67. When such abutment occurs, the distal end 77 defined by the plug neck 74 extends in substantially flush relation to the exterior surface of the cap base 56 of the cap 50. Importantly, when the plug neck 74 assumes this particular orientation relative to the cap 50, a small segment of the slot 79 fluidly communicates with the reservoir 40. At the same time, the larger diameter portion of the plug neck 74 moves out of engagement with the sealing ring 61 of the cap 50, thus effectively breaking the fluid-tight seal between the plug 72 and the cap 50.

As will be recognized, the movement of the plug flange 76 from within and out of sealed engagement to the projection 47 of the cartridge body 38 effectively unblocks the opening 46 as allows for the flow of a fluid or liquid from within the interior of the reservoir 40 through the opening 46. Such flow through the opening 46 is aided by the venting function facilitated by the partial overlap and hence the fluid communication between the slot 79 and the reservoir 40. In this regard, when the plug 72 is moved to its dispensing position, air is capable of flowing into the reservoir 40 via the open interior of the plug neck 74 and the slot 79. As will be recognized by those of ordinary skill in the art, the plug 72 will be operatively coupled to the cap 50 and the cartridge body 38 so as to assume its sealing position prior to the filling of the reservoir 40 with a concentrated fluid or chemical agent via the opening 68 of the cartridge body 38.

It is contemplated that the refill cartridge 36 possessing the above-described structural and functional attributes will be sold with the bottle 12 and the pumping mechanism 22 in the arrangement shown in FIG. 1, i.e., the refill cartridge 36 will be stored inside the bottle 12 at the point of sale. Advantageously, due to the configuration of the refill cartridge 36, the same may be maintained in a storage position or state wherein the plug 72 is maintained in its sealing position and the concentrated chemical agent maintained in the reservoir 40 despite the pumping mechanism 22 being operatively coupled to the bottle 12. As previously explained, the movement of the plug 72 from its sealing position to its dispensing position as shown in FIG. 1 is facilitated solely by the application of pressure thereto by an external object (other than for the pumping mechanism 22) such as the finger of the consumer. In this regard, the structure of the refill cartridge 36 is not suited to causing the concentrated chemical agent stored in the reservoir 40 to be dispensed from therein as a result of the attachment of the pumping mechanism 22 to the bottle 12. This represents a departure from prior art devices wherein the refill cartridge cannot be sold inside the bottle, but rather must be sold separately, since the movement of such prior art refill cartridge from a storage state to a dispensing state wherein a chemical agent is dispensed therefrom is facilitated by the engagement of a portion of the pumping mechanism thereto as occurs during the process of attaching the pumping mechanism to the bottle.

It is also contemplated that the refill cartridge 36 may be sold separate from the bottle 12 and the pumping mechanism 22. In other words, a user may purchase the refill cartridge 36 to refill the bottle 12 when the fluid within the bottle 12 is empty. It is also contemplated that the refill cartridge 36 may be sold with the bottle 12 (with or without the pumping mechanism 22) without being stored inside the bottle 12, or also may be sold solely with the pumping mechanism 22. If sold with the bottle 12 alone, the cartridge 36 and bottle 12 may be used with an existing pumping mechanism 22. Conversely, if sold with a pumping mechanism 22 alone, the refill cartridge 36 and pumping mechanism 22 may be used with an existing bottle 12. However, as indicated above, the most common contemplated usage of the refill cartridge 36 is for it to be sold with and stored inside a new bottle 12 and pumping mechanism 22, with the bottle 12 already being filled with a fluid for dispensing by the pumping mechanism 22. In this instance, when the fluid level within the bottle 12 decreases to the point where bottle 12 is effectively empty, the fluid or concentrated chemical agent within the on-board refill cartridge 36 may be used to refill the bottle 12. When the refill cartridge 36 is provided with the new bottle 12, the abutted flanges 54, 45 which overlie the rim of the bottle 12 are secured to the rim by the pump attachment element 30 of the pumping mechanism 22. The tube 32 of the pumping mechanism 22 is extended through and is thus accommodated by the flow passage 84 of the plug 72 as described above.

An exemplary use of the refill cartridge 36, when sold with and stored in the new bottle 12 and pumping mechanism 22, is as follows. When the fluid level in the bottle 12 is sufficiently low, the pumping mechanism 22 is removed from the bottle 12 to provide access to the refill cartridge 36 originally stored therein. In most cases, the fluid within the refill cartridge 36 contains a highly concentrated level of the fluid that was previously in the bottle 12. The refill cartridge 36 is removed from within the interior of the bottle 12 by grasping the abutted flanges 54, 45 which overlie the rim of the bottle 12. Thereafter, water or other diluting fluid may be filled into the bottle 12 prior to dispensing the fluid within the refill cartridge 36 into the bottle 12. Typically, if the fluid within the refill cartridge 36 is filled into the bottle 12 prior to filling a diluting fluid in the bottle 12, the concentrated fluid emptied into the bottle 12 will begin to bubble as the diluting fluid is filled into the bottle 12. Therefore, it may be desirable to fill the diluting fluid into the bottle 12 prior to filling the concentrated fluid from the refill cartridge 36 into the bottle 12. To this end, the bottle 12 may include a marking to indicate how much diluting fluid is required for use with the concentrated fluid.

After the diluting fluid is sufficiently filled within the bottle 12, the cartridge 36 is reinserted into the bottle 12 by passing it through the bottle opening and resting the abutted flanges 54, 45 upon the bottle rim which defines the bottle opening, as shown in FIG. 1. The concentrated fluid within the refill cartridge 36 may then be dispensed into the bottle 12. To dispense the fluid within the refill cartridge 36, the plug neck 74 is pushed by a user from the sealing position toward the dispensing position. More specifically, the distal end 77 is pushed by a user toward the cap base 56. In this regard, the fluid tight seal between the flared portion 78 and the projection 47 is broken in the above-described manner, thereby allowing the fluid within the refill cartridge 36 to exit the cartridge reservoir 40 via the second opening 46 and into the bottle 12. After the fluid is dispensed into the bottle 12, the pumping mechanism 22 is reattached to the bottle 12. At this point, the empty refill cartridge 36 preferably remains within the bottle 12. However, the empty refill cartridge 36 may be replaced at this time with a new, full refill cartridge 36 before reattaching the pumping mechanism 22 to the bottle 12. After the pumping mechanism 22 is connected to the bottle 12, the user may then shake the bottle 12 to mix the highly concentrated fluid with the diluting fluid. Once the fluids are mixed, the spray bottle assembly 10 may be used to dispense the fluid.

Figure 14:
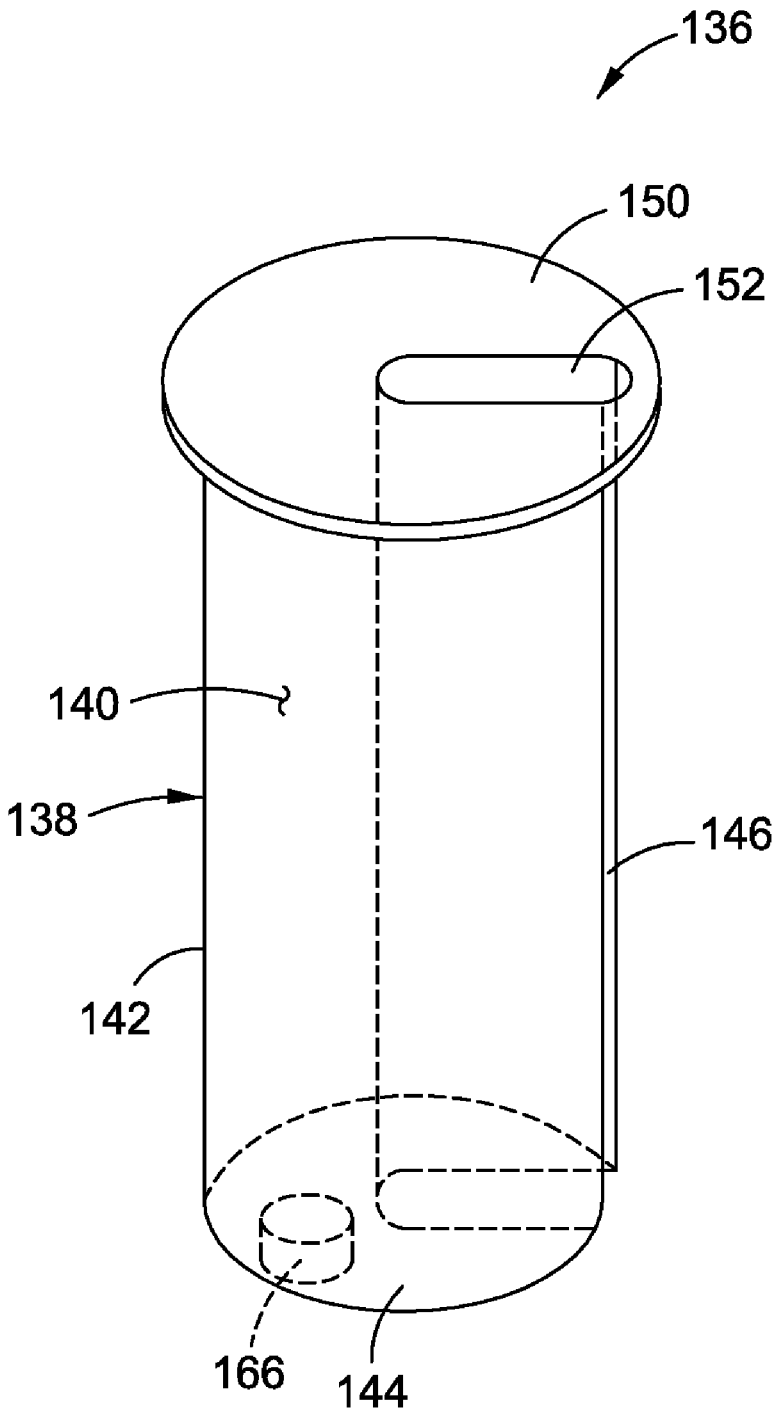
FIG. 14 is a top perspective view of an alternative embodiment of the refill cartridge.

Referring now to FIG. 14, there is shown a refill cartridge 136 constructed in accordance with an alternative embodiment of the present invention which may be substituted for the above-described refill cartridge 36. The refill cartridge 136 includes a cartridge body 138 defining a reservoir 140 configured to store fluid. In this manner, the cartridge body 138 is preferably formed of a fluid impermeable material, such as plastic or rubber. As shown in FIG. 14, the cartridge body 138 has a substantially cylindrical configuration, and includes a side wall 142, a bottom wall 144 which is integrally connected to one end of the side wall 142, and a top wall (not shown) which is integrally connected to the remaining end of the side wall 142. Formed in the side wall 142 of the cartridge body 138 is an elongate channel 146 which extends from the bottom wall 144 to the top wall. The channel 146 is used for reasons which will be described in more detail below.

It addition to the cartridge body 138, the refill cartridge 132 includes a cap 150 that is attached to the top wall of the cartridge body 138. The cap 150 is sized so as to include a peripheral portion which protrudes radially outward relative to the outer surface of the side wall 142 of the cartridge body 138. The cap 150 also includes an elongate slot 152 formed therein which communicates with the channel 146 in the manner shown in FIG. 14. Those of ordinary skill in the art will recognize that the cartridge body 138 may be formed so as not to include the top wall, with the cap 150 being integrally connected to the side wall 142 such that the slot 152 communicates with the channel 146 in the aforementioned manner.

As is further shown in FIG. 14, it is contemplated that the bottom wall 144 may include a ring-like projection 166 which extends therefrom and is offset from the center thereof. The projection 166 defines an opening that extends through the bottom wall 144 and fluidly communicates with the reservoir 140 of the cartridge body 138. In this regard, the refill cartridge 136 may be filled with the fluid via the opening of the projection 166, with such opening being sealed with a suitable plug once the reservoir 140 is filled with the fluid.

When sold with the bottle 12, the refill cartridge 136 resides within the reservoir 16 of the bottle 12, with the peripheral portion of the cap 150 which overhangs the cartridge body 138 resting on the rim of the bottle 12 in the same manner as the flange 45 of the above-described refill cartridge 36. The attachment of the pumping mechanism 22 to the bottle 12 effectively compresses the peripheral portion of the cap 150 between the pump attachment element 30 and the rim, thus securing the refill cartridge 136 to the bottle 12. At the same time, the tube 32 of the pumping mechanism 22 is accommodated by the channel 146 and the slot 152 within the cap 150, the tube 32 extending through the refill cartridge 136.

When the fluid level in the bottle 12 is sufficiently low, the pumping mechanism 22 is removed from the bottle 12 to provide access to the refill cartridge 136. The refill cartridge 136 is removed from within the interior of the bottle 12 by grasping the peripheral portion of the cap 150 which overlies the rim of the bottle 12. Thereafter, water or other diluting fluid may be filled into the bottle 12 prior to dispensing the fluid within the refill cartridge 136 into the bottle 12. After the diluting fluid is sufficiently filled within the bottle 12, the plug is removed from within the projection 166, with the contents of the refill cartridge 136 thereafter being poured into the diluting fluid within the bottle 12. After the concentrated fluid is dispensed into the bottle 12, the pumping mechanism 22 is reattached to the bottle 12. At this point, the empty refill cartridge 136 preferably remains within the bottle 12. However, the empty refill cartridge 136 may be replaced at this time with a new, full refill cartridge 136 before reattaching the pumping mechanism 22 to the bottle 12. After the pumping mechanism 22 is connected to the bottle 12, the user may then shake the bottle 12 to mix the highly concentrated fluid with the diluting fluid. Once the fluids are mixed, the spray bottle assembly 10 may be used to dispense the fluid.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A refill assembly adapted for actuation by an external object such as user's finger which does not comprise any portion of the refill assembly, the refill assembly comprising:

a bottle defining an internal reservoir and an opening which communicates with the reservoir; and a refill cartridge cooperatively engaged to the bottle and at least partially residing within the reservoir thereof, the refill cartridge including:

a cartridge body defining a cartridge reservoir having a concentrated chemical agent stored therein, the cartridge body including at least two elongate support arms extending into the reservoir in spaced relation to each other; and a plug cooperatively engaged to the cartridge body and selectively moveable from a sealing position to a dispensing position relative thereto, the movement of the plug from the sealing position to the dispensing position facilitating the flow of the chemical agent from the cartridge reservoir into the reservoir of the bottle solely as a result of the application of compressive pressure to a prescribed portion of the plug by the external object;

the plug including a radially extending flange which is abutted against the support arms when the plug is in the dispensing position.

2. The refill assembly of claim 1 wherein the opening of the bottle is defined by a rim thereof, and the cartridge body includes a flange portion which is abutted against the rim.

3. The refill assembly of claim 2 further comprising a pumping mechanism cooperatively engaged to the bottle in manner maintaining the flange portion of the cartridge body in abutting contact with the rim of the bottle.

4. The refill assembly of claim 3 wherein:

the pumping mechanism includes a nozzle and a fluid tube which is connected to the nozzle and advanced into the bottle reservoir; and the plug is tubular, with the fluid tube of the pumping mechanism passing therethrough.

5. The refill assembly of claim 1 wherein the refill cartridge further comprises a cap connected to the cartridge body, the cartridge reservoir being collectively defined by the cartridge body, the plug and the cap.

6. The refill assembly of claim 5 wherein the plug is frictionally engaged to and protrudes from the cap when the plug is in the sealing position, and is frictionally engaged to the cartridge body when the plug is in the sealing position, the application of pressure to that portion of the plug protruding from the cap by the external object facilitating the movement of the plug from the sealing position to the dispensing position.

7. The refill assembly of claim 6 wherein:

the cap includes a tubular boss defining a flow passage which fluidly communicates with the cartridge reservoir;

the cartridge body includes a tubular projection defining an opening which fluidly communicates with the cartridge reservoir; and the plug is frictionally engaged to the boss and the projection, with the movement of the plug to the dispensing position facilitating the formation of a fluid flow path between the projection and a portion of the plug.

8. The refill assembly of claim 7 wherein the plug is tubular and includes a plug neck which is frictionally engaged to and creates a fluid tight seal with the boss when the plug is in the sealing position, and a flared portion which is frictionally engaged to and creates a fluid tight seal with the projection when the plug is in the sealing position, but is disposed in spaced relation to the projection upon the movement of the plug to the dispensing position such that the fluid flow path is defined between the plug and the cartridge body.

9. The refill assembly of claim 8 wherein the boss of the cap includes a sealing ring formed therein which is frictionally engaged to and creates a fluid tight seal with the plug neck when the plug is in the sealing position, and the projection includes a sealing ring formed therein which is frictionally engaged to and creates a fluid tight seal with the flared portion when the plug is in the sealing position.

10. The refill assembly of claim 8 wherein the plug neck includes a slot formed therein which is sized and configured to create an air flow path from the exterior of the refill cartridge into the reservoir thereof when the plug is moved to the dispensing position.

11. The refill assembly of claim 8 wherein the plug neck defines a first portion which is of a first outer diameter, and a second portion which is of a second outer diameter exceeding the first outer diameter, the first portion of the plug neck being frictionally engaged to and creating a fluid tight seal with the sealing ring of the plug neck when the plug is in the sealing position.

12. A refill cartridge configured for use with a bottle having a reservoir, the refill cartridge comprising:

a cartridge body defining a cartridge reservoir having a concentrated chemical agent stored therein, the cartridge body including at least two elongate support arms extending into the cartridge reservoir in spaced relation to each other; and a plug cooperatively engaged to the cartridge body and selectively moveable from a sealing position to a dispensing position relative thereto, the movement of the plug from the sealing position to the dispensing position facilitating the flow of the chemical agent from the cartridge reservoir into the reservoir of the bottle;

the plug including a radially extending flange which is abutted against the support arms when the plug is in the dispensing position.

13. The refill cartridge of claim 12, wherein the refill cartridge further comprises a cap connected to the cartridge body, the cartridge reservoir being collectively defined by the cartridge body, the plug and the cap, with the plug being frictionally engaged to and protruding from the cap when the plug is in the sealing position, and being frictionally engaged to the cartridge body when the plug is in the sealing position, the application of pressure to that portion of the plug protruding from the cap by the external object facilitating the movement of the plug from the sealing position to the dispensing position.

14. The refill cartridge of claim 13 wherein:

the cap includes a tubular boss defining a flow passage which fluidly communicates with the cartridge reservoir;

the cartridge body includes a tubular projection defining an opening which fluidly communicates with the cartridge reservoir; and the plug is frictionally engaged to the boss and the projection, with the movement of the plug to the dispensing position facilitating the formation of a fluid flow path between the projection and a portion of the plug.

15. The refill cartridge of claim 14 wherein the plug is tubular and includes a plug neck which is frictionally engaged to and creates a fluid tight seal with the boss when the plug is in the sealing position, and a flared portion which is frictionally engaged to and creates a fluid tight seal with the projection when the plug is in the sealing position, but is disposed in spaced relation to the projection upon the movement of the plug to the dispensing position such that the fluid flow path is defined between the plug and the cartridge body.

16. The refill cartridge of claim 15 wherein the boss of the cap includes a sealing ring formed therein which is frictionally engaged to and creates a fluid tight seal with the plug neck when the plug is in the sealing position, and the projection includes a sealing ring formed therein which is frictionally engaged to and creates a fluid tight seal with the flared portion when the plug is in the sealing position.

17. The refill cartridge of claim 15 wherein the plug neck includes a slot formed therein which is sized and configured to create an air flow path from the exterior of the refill cartridge into the reservoir thereof when the plug is moved to the dispensing position.

* * * * *